US005888002A

United States Patent [19]

Fenstersheib

[11] Patent Number: 5,888,002

[45] Date of Patent: Mar. 30, 1999

[54] DISPOSABLE TOILET BRUSH

[76] Inventor: Robert J. Fenstersheib, 5940 SW. 37th Terrace, Ft. Lauderdale, Fla. 33312

[21] Appl. No.: 893,819

[22] Filed: Jul. 11, 1997

[51] Int. Cl.[6] ..... A46B 11/00; A46B 11/04

[52] U.S. Cl. ..... 401/28; 15/104.93; 15/104.94; 401/268; 401/290

[58] Field of Search ..... 15/104.93, 104.94; 401/28, 268, 290

[56] References Cited

U.S. PATENT DOCUMENTS

| | | | |
|---|---|---|---|
| 1,205,894 | 11/1916 | Hilfiker | 401/28 |
| 5,010,615 | 4/1991 | Carter | 15/104.94 |
| 5,373,599 | 12/1994 | Lemon et al. | 15/104.94 |
| 5,488,748 | 2/1996 | Koch | 15/104.94 |
| 5,630,243 | 5/1997 | Federico et al. | 15/104.94 |

FOREIGN PATENT DOCUMENTS

| | | | |
|---|---|---|---|
| 1026738 | 4/1966 | Br. Indian Ocean Ter. | 15/104.94 |
| 2624361 | 6/1989 | France | 15/140.94 |
| 496181 | 4/1930 | Germany | 401/28 |

*Primary Examiner*—Steven A. Bratlie

[57] ABSTRACT

A new concept toilet cleaning system that, in its preferred embodiment, includes a low cost disposable cleaning brush that is preconditioned with a detergent and disinfectant cleaning agent on its bristles is presented. The cleaning agent may take a dried or liquid form and may be disposed in openings in the bristles in some configurations. The brushes are meant to be of very low cost molded manufacture and are designed to nest for shipment and storage. The user simply removes one of the disposable toilet cleaning brushes from a package, rinses it in clean toilet water to activate the cleaning agent, cleans the toilet with the brush, and then disposes of the brush in a disposal bag that is normally supplied with the shipping and sales package. Options include a variant that has a liquid cleaning agent built into a squeezable reservoir that is part of the handle whereby squeezing of the reservoir disperses the liquid cleaning agent to the brush's bristles. Applications, in addition to standard household toilets, include hotels, hospitals, schools, and the like.

7 Claims, 2 Drawing Sheets

5,6,7,8
41
30
36

3,4
41
41
30
36

34
35

31
38
40
36
41

41
41
36
30
41
30
36
38
41

44
37
41
36

38
39
41
36

FIG. 11
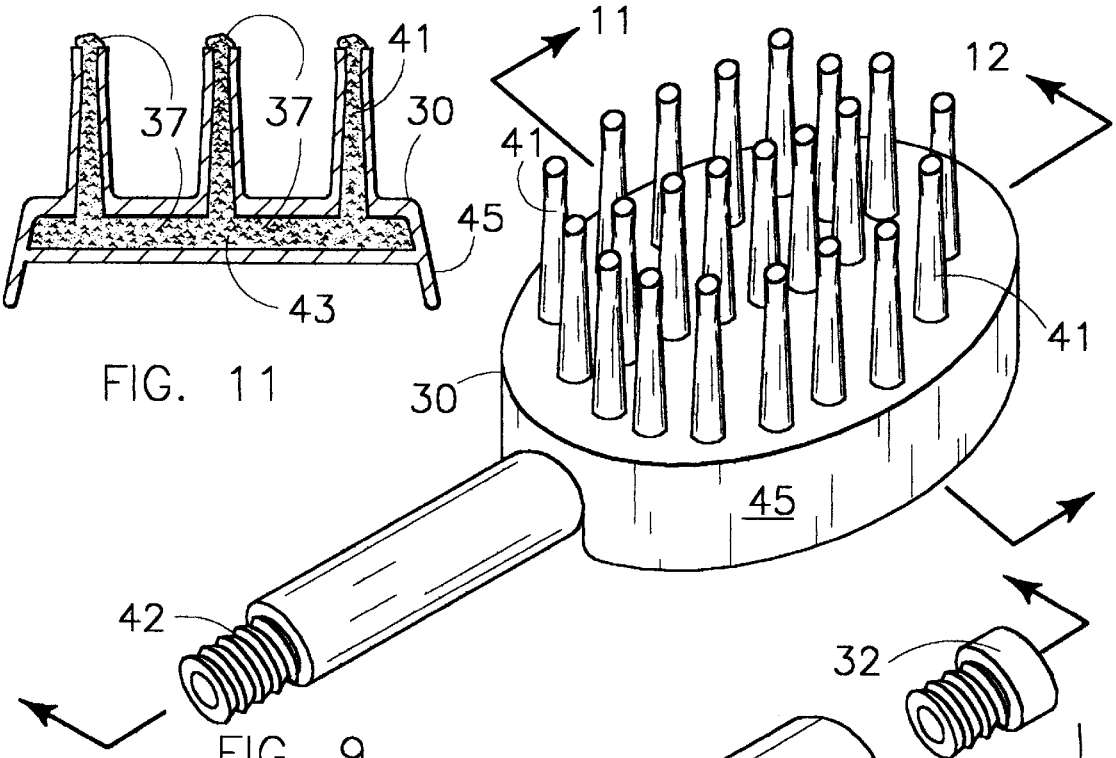
FIG. 9
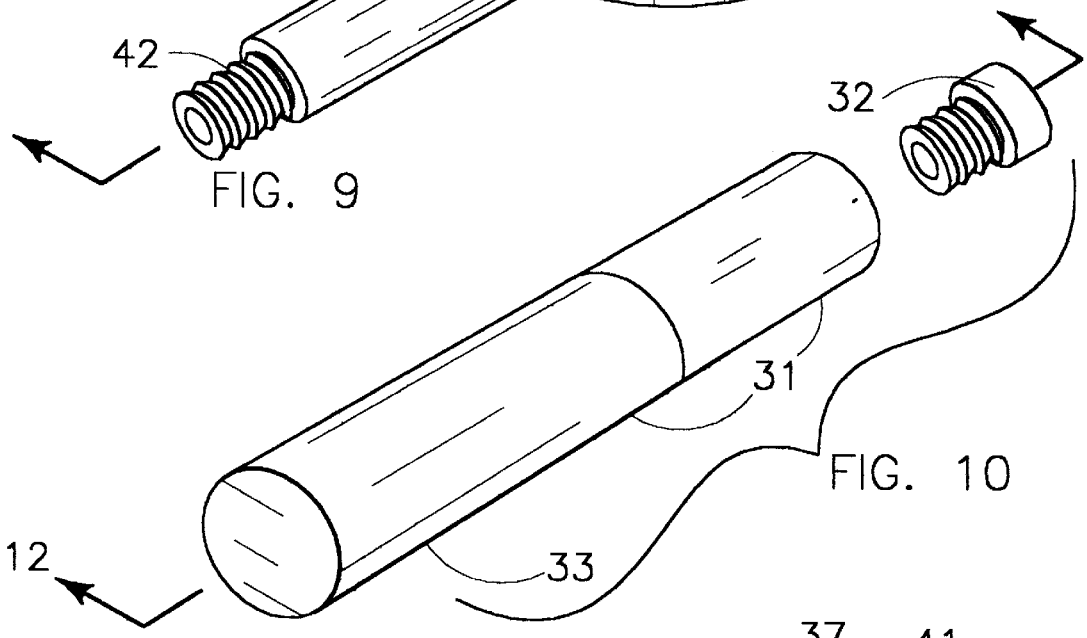
FIG. 10
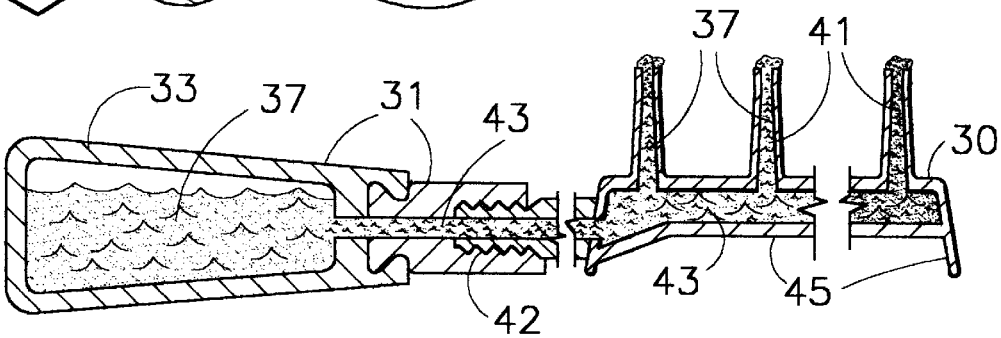
FIG. 12

DISPOSABLE TOILET BRUSH

FIELD OF THE INVENTION

The instant invention offers a simple low cost disposable toilet brush that in its optimum embodiment includes a detergent and/or disinfectant agent. The detergent and/or disinfectant is supplied as part of the brush package either as a dried material adhered to brush bristles or as a liquid disposed either inside hollow brush bristles or in a squeezable reservoir in liquid communication with the brush bristles. It generally falls into the field of cleaning brushes with particular application to toilet cleaning devices.

BACKGROUND OF THE INVENTION

Cleaning of toilets is an unsanitary task that is exasperated by the need to store a contaminated brush between uses. The user of a toilet brush is also subject to obvious medical hazards related to bacteria and contaminants in the toilet. This is bad enough for toilets in private homes but is particularly troublesome for toilets in hospitals, hotels, and other commercial locations.

Heretofore there have been no low cost disposable toilet brushes. It would be possible to purchase a standard toilet brush and dispose it after each use; however, that would be rather costly as the standard toilet brush is rather durably built since it is meant to be reused over a substantial period of time. The normal procedure for use is to spray a detergent and/or disinfectant liquid around the inside of the toilet bowl and then brush the bowl. The brush is then rinsed by dipping it into the toilet water and stored for future use. All parts of this procedure leave the user subject to dirt and disease plus the stored brush is normally contaminated and unsightly.

The instant invention offers a low cost, attractive, and viable solution for cleaning toilets as it is provides a truly antiseptic disposable toilet cleaning system. In its preferred embodiment it is supplied with built in detergent and/or disinfectant agents and a disposal bag. From a cost competition standpoint, the preferred method of design and manufacture calls for a one piece flexible rubberlike plastic material that lends to high volume low cost molding. The bristles of the molded brush, in the preferred embodiment, are dipped in a solution of detergent and/or disinfectant which is then dried on the bristles. Since the brushes are optimally designed to nest for shipment and storage several brushes are conveniently supplied in one sales and storage package where said sales and storage package can also contain an equal number of disposal bags.

The beauty of all of this is that the user simply removes one chemically treated brush from the storage package, rinses same in clean toilet water to activate the chemical agent(s), brushes the toilet bowl clean, and then disposes of the used toilet brush in the disposal bag provided. There are no requirements for handling, cleaning, or storing of the contaminated brush head or bristles after cleaning of the toilet.

Alternative embodiments of the instant invention call for liquid detergents and/or disinfectants. The first approach is similar to the previously described system except that liquid chemicals are entrapped in hollow compartments in the ends of the bristle. In this instance, the liquid chemicals are released upon rubbing the brush bristles against the toilet bowl. A multiple-use concept that uses a liquid chemical approach has a squeezable liquid chemical reservoir that is in liquid communication with the brush bristles. As the user squeezes the reservoir the liquid chemicals are dispensed to the bristles during toilet cleaning.

In contrast to disease and contaminant prone prior art reusable toilet brushes, the instant invention, particularly in its preferred embodiment, offers a low cost disposable toilet cleaning system. Use of detergent and/or disinfectant agents pre-applied to the instant invention brush's bristles greatly simplifies use. That feature coupled with a concept that nests low cost molded brushes for shipment and storage in a single package where said package also includes brush disposal bags makes for a very attractive solution to the very nasty problem of toilet cleaning. The prior art does not address this.

German patent 496,181 shows hollow bristles to which end a liquid cleaning agent, supplied thorough a handle "h", can be ejected through its bristles marked "f" as well as other hollow bristles marked "e". The "e" bristles are also hollow; however, they are angled outward from the a center of the dispensing head. Further, all bristles show constant diameter and not tapered hollows. Therefore, German patent 496,181 cannot accomplish the nesting of bristles and hence brushes as does the instant invention because German patent 496, 181 has the following shortcomings that render it unable to accomplish such nesting: 1) Bristle hollows are constant diameter and not tapered, 2) Many bristles are angled outward from the center of the brush head, and 3) The back side of the brush head is enclosed by a cover. Because of any of the three aforementioned reasons, singularly or in combination, nesting of German patent 496,181 cleaning brushes is not possible.

SUMMARY OF THE INVENTION

With the foregoing in mind, it is the principal object of the instant invention to provide a simple low cost toilet cleaning system including a disposable toilet brush suitable for use in private homes and/or commercial establishments such as hotels, hospitals, and the like.

A related object of the invention is that a detergent agent be supplied as an integral part of the toilet cleaning system.

Another object of the invention is that a disinfectant agent be supplied as an integral part of the toilet cleaning system.

It is a directly related object of the invention that a detergent and a disinfectant agent can be supplied in combination as an integral part of the toilet cleaning system.

It is a related object of the invention that the term "cleaning agent" can be used to describe either a detergent agent, a disinfectant agent, or a combination of the two.

A further object of the invention is that any cleaning agents can be supplied in dried form attached either externally or internally to brush bristles.

Another object of the invention is that brush bristles can be hollow at least over a portion of their length.

A related object of the invention is that a liquid cleaning agent can be supplied internal to hollow bristles of the disposable brush.

Yet another object of the invention related to use of liquid cleaning agents is that a reservoir, normally squeezable, can be used to supply liquid cleaning agents to the brush bristles.

A further object of the invention is that a reusable handle can be supplied to extend the reach of the instant invention disposable toilet brush.

A directly related object of the invention is that the reusable handle can be easily affixed by a snap lock mechanism or other rapid attachment means.

It is a major object of the invention that the brush head be moldable as a low cost single piece item of, preferably, a flexible plastic material.

It is a related object of the invention that the disposable toilet brush head be shaped so that it nests for shipment and storage.

A related object of the invention is that the bristles can be hollow, either full length or only partial length, to aid in manufacture and nesting for storage.

Yet another object of the invention is that the disposable toilet brush will be packed several in a package where said package can include a like number of disposal bags.

The invention will be better understood upon reference to the drawings and detailed description of the invention which follow in which:

BRIEF DESCRIPTION OF THE DRAWINGS

FIG. 9 presents an isometric view of an alternative embodiment of the instant invention whereby a liquid cleaning agent is dispensed through hollow bristles.

FIG. 10 is a handle including a squeezable reservoir containing the liquid cleaning agent for the brush head of FIG. 9.

FIG. 11 is a cross-sectional view, as taken through line 11—11 of FIG. 9, that shows the internal to the brush head liquid cleaning flow passageways and how the liquid cleaning fluid is dispensed through hollow bristles.

FIG. 12 is a cross-sectional view, as taken through line 12—12 of FIGS 9 and 10, that shows a squeezable fluid cleaning reservoir that is part of a handle and that is in fluid communication with the brush cleaning head and bristles.

DETAILED DESCRIPTION

Figures 1, 2, 3, 4, 5, 6, 7, 8:
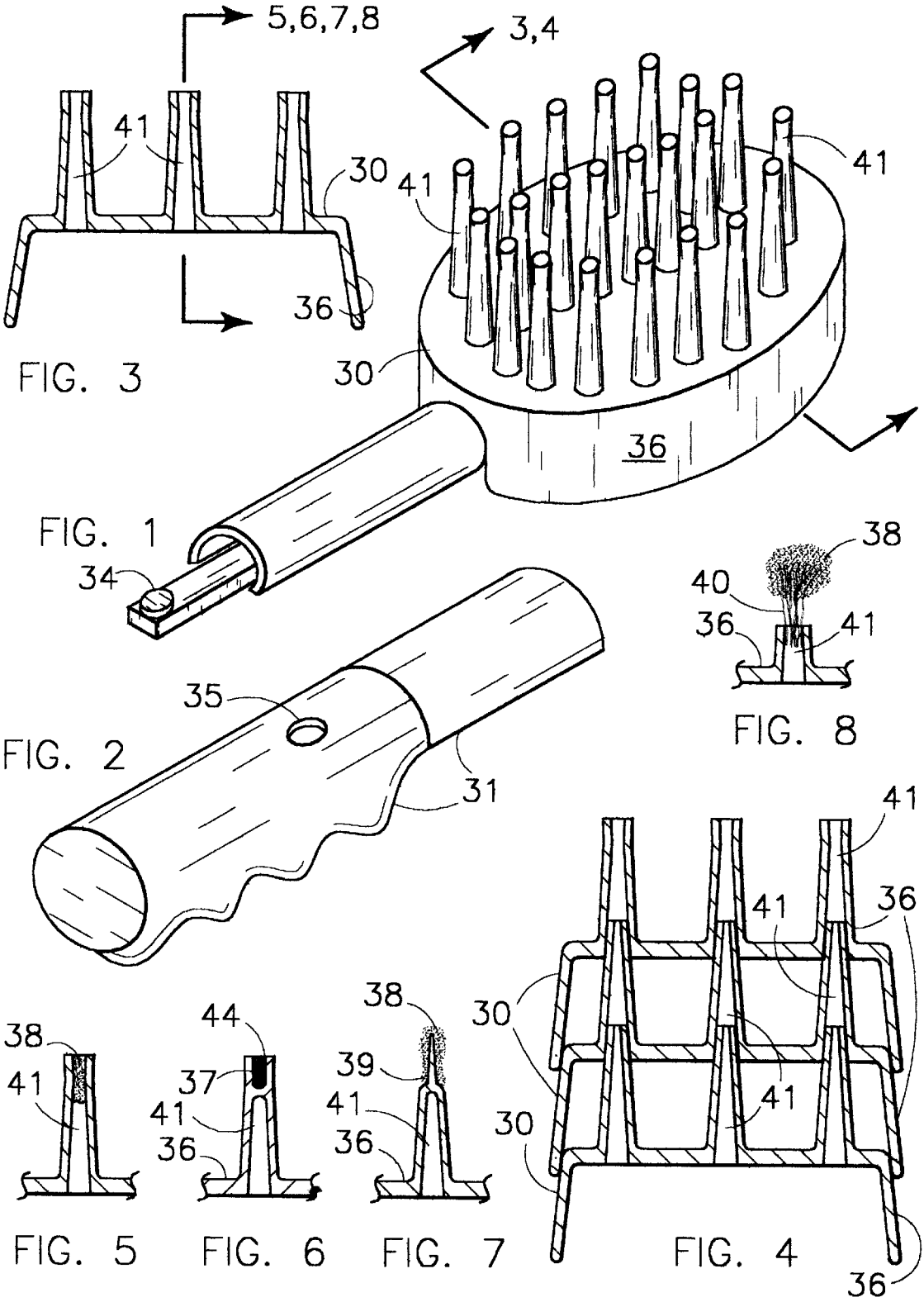
FIG. 1 presents an isometric drawing showing the disposable toilet brush head including integral molded on bristles.
FIG. 2 shows an optional reusable handle that can snap onto the disposable head in this preferred configuration.
FIG. 3 is a cross-sectional view, as taken through line 3—3 of FIG. 1, that shows details of the brush head including the hollow bristle concept.
FIG. 4 is also a cross-sectional view, as taken through line 4—4 of FIG. 1, but adding two additional brush heads to illustrate the procedure for nesting of the brushes.
FIG. 5 is a partial cross-sectional view, as taken through line 5—5 of FIG. 3, that shows a hollow bristle with a dried cleaning agent internal to the bristle.
FIG. 6 is another partial cross-sectional view of a bristle, as taken through line 6—6 of FIG. 3, that shows a liquid cleaning agent encapsulated in a hollow end of a bristle.
FIG. 7 is yet another partial cross-sectional view of a bristle, as taken through line 7—7 of FIG. 3, that depicts a molded on bristle that is coated with a cleaning agent.
FIG. 8 shows a partial cross-sectional view, as taken through line 8—8 of FIG. 3, the illustrates a group of separate independent bristles inserted into a brush head. This approach is generally considered a workable but generally more expensive concept.

FIG. 1 presents an isometric view of a preferred embodiment of the disposable toilet cleaning brush 30. In this case the brush head 36 includes molded in place bristles 41. An optional handle snap 34 is also shown.

FIG. 2 is another isometric view but of the optional reusable handle that attached to the brush head of FIG. 1. The handle snap of FIG. 1 engages the handle snap recess 35 when the handle is attached.

FIG. 3 is a cross-sectional view, as taken through line 3—3 of FIG. 1, that shows brush head bristles 41 that in this preferred embodiment are hollow.

FIG. 4 is another cross-sectional view, as taken through line 4—4 of FIG. 1, that illustrates nesting of several brush heads 36 which in this case uses bristles 41 that are hollow.

FIG. 5 is a partial cross sectional-view, as taken through line 5—5 of FIG. 3, that shows a bristle 41 that is hollow and has its end filed with a dried cleaning agent 38.

FIG. 6 presents an alternative liquid cleaning agent 37 as encapsulated in a reservoir end 44 of a bristle 41. This is a partial cross-sectional view, as taken through line 6—6 of FIG. 3.

FIG. 7 gives a view, as taken through line 7—7 of FIG. 3, that shows another variation of using a dried cleaning agent 38 where it is applied to a molded bristle extension 39 that is part of bristle 41. Note that more than one molded bristle extensions 39 can be employed.

FIG. 8 offers yet another method of applying bristles in a view, as taken through line 8—8 of FIG. 3, that shows multiple separate bristle members 40 as inserted in a brush bristle 41. It is obvious that this approach will add cost to brush head 36 cost; however, aside from increased manufacturing cost it is a viable option.

FIG. 9 presents an isometric view of an alternative embodiment of the instant invention toilet cleaning brush 30 what uses a liquid cleaning agent dispensed through bristles 41 in liquid dispensing head 45. Screw threads 42 for handle attachment are also shown.

FIG. 10 is an isometric view of a handle 31 that screws to the bead of FIG. 9. A liquid clanging agent reservoir 33, in this instance a squeezable bulb, and a protective storage cap 32 are also shown.

FIG. 11 is a cross-sectional view, as taken through line 11—11 of FIG. 9, that shows liquid flow passageways 43 in liquid dispensing brush head 45. Note that the liquid cleaning agent 37 is shown dispensing from ends of hollow bristles 41 in this instance.

FIG. 12 presents a cross-sectional view, as taken through line 12—12 of FIGS. 9 and 10, that illustrates the fluid communication path for the liquid cleaning agent 37 while passing from the squeezable reservoir 33 to the hollow bristles 41.

While the invention has been described in connection with a preferred and several alternative embodiments, it will be understood that there is no intention to thereby limit the invention. On the contrary, there is intended to be covered all alternatives, modifications and equivalents as may be included within the spirit and scope of the invention as defined by the appended claims which are the sole definition of the invention.

What I claim is:

1. In an improved cleaning brush of the type having cleaning bristles, the improvement comprising:

said cleaning bristles molded as part of a head of the cleaning brush and having ends coated with a cleaning agent wherein said cleaning agent is activated by contact with a liquid and said cleaning brush disposable after use, a hollow in at least one of the multiple cleaning bristles whereby a cleaning bristle from an additional cleaning brush inserts into said hollow, and the cleaning brush and said additional cleaning brush nest for shipment and storage.

2. The improved cleaning brush of claim 1 wherein the molded cleaning bristles are, at least in part, hollow.

3. The improved cleaning brush of claim 1 which further comprises a reusable handle that is sequentially useable with multiple cleaning brushes.

4. The improved cleaning brush of claim 3 wherein means of attachment of said reusable handle to the cleaning brush is at least in part a handle snap.

5. In an improved cleaning brush of the type having cleaning bristles, the improvement comprising:

said cleaning bristles molded as part of a head of the cleaning brush, said molded cleaning bristles include a cleaning agent that is actuated upon rubbing the molded cleaning bristles upon a hard surface, said cleaning brush disposable after use, a hollow in at least one of the multiple cleaning bristles whereby a cleaning bristle from an additional cleaning brush inserts into said hollow, and the cleaning brush and said additional cleaning brush nest for shipment and storage.

6. The improved cleaning brush of claim 5 which further comprises a reusable handle that is sequentially useable with multiple cleaning brushes.

7. The improved cleaning brush of claim 6 wherein means of attachment of said reusable handle to the cleaning brush is at least in part a handle snap.

* * * * *